US006406315B1

(12) United States Patent
Bates, III et al.

(10) Patent No.: US 6,406,315 B1
(45) Date of Patent: Jun. 18, 2002

(54) MECHANISM FOR COUPLING OF CONNECTOR ARRAY

(75) Inventors: Charles Linsday Bates, III, Laguna Hills; Peter Joseph Hyzin, Trabuco Canyon, both of CA (US)

(73) Assignee: ITT Manufacturing Enterises, Inc., Wilmington, DE (US)

( * ) Notice: Subject to any disclaimer, the term of this patent is extended or adjusted under 35 U.S.C. 154(b) by 0 days.

(21) Appl. No.: 09/702,916

(22) Filed: Oct. 30, 2000

(51) Int. Cl.[7] ..... H01R 13/627
(52) U.S. Cl. ..... 439/310; 439/362
(58) Field of Search ..... 439/310, 362, 439/364

(56) References Cited

U.S. PATENT DOCUMENTS

| | | | | |
|---|---|---|---|---|
| 2,069,882 | A | 2/1937 | Hall | 81/57 |
| 3,432,795 | A | 3/1969 | Jayne | |
| 4,284,315 | A | 8/1981 | Williams | |
| 4,340,789 | A | 7/1982 | Williams | 200/11 |
| 4,935,847 | A | 6/1990 | Welsh | 361/415 |
| 4,955,821 | A | 9/1990 | Bernardini | 439/133 |
| 5,098,312 | A | 3/1992 | Raczynski | 439/362 |
| 5,169,334 | A | 12/1992 | Makita | 439/362 |
| 5,218,758 | A | 6/1993 | Nguyen | 29/837 |
| 5,295,756 | A | 3/1994 | Ohta | 403/407 |
| 5,344,347 | A | 9/1994 | Inoue et al. | 439/701 |
| 5,562,458 | A | 10/1996 | Stora et al. | 439/348 |
| 5,727,969 | A | 3/1998 | Yamanashi | 439/594 |
| 5,800,197 | A | 9/1998 | Hyzin | 439/372 |

*Primary Examiner*—Khiem Nguyen
(74) *Attorney, Agent, or Firm*—Roger C. Turner

(57) ABSTRACT

A mechanism is provided for moving each of a plurality of second connectors (32) into engagement with each of a plurality of first connectors (31), where selective movement of the second connectors can be accomplished at a front panel (54) that is distant from the connectors. An elongated turning member (52) has a front end handle (50) that can be turned about an axis (122), with the rear of the turning member coupled to a selected one of a plurality of gear devices (61–64) that each moves a different second connector when that gear device is turned. A selector (70) that extends parallel to the turning member, has a selector front end handle (72) that can be turned to a selected position, to turn cam portions (132–135) at the rear end of the selector. Each cam portion can push a corresponding coupler (120) that can slide within a slot (134) in the turning member, so the coupler engages a cutout (124) in the gear device to thereby rotatably connect the turning member to the gear device. In another arrangement, the selector (252) is slideable along the axis (122B) of the turning member to different positions to cause coupling members (261–264) to slide into engagement with walls of a cutout (270) in a selected gear device.

17 Claims, 5 Drawing Sheets

FIG. 5
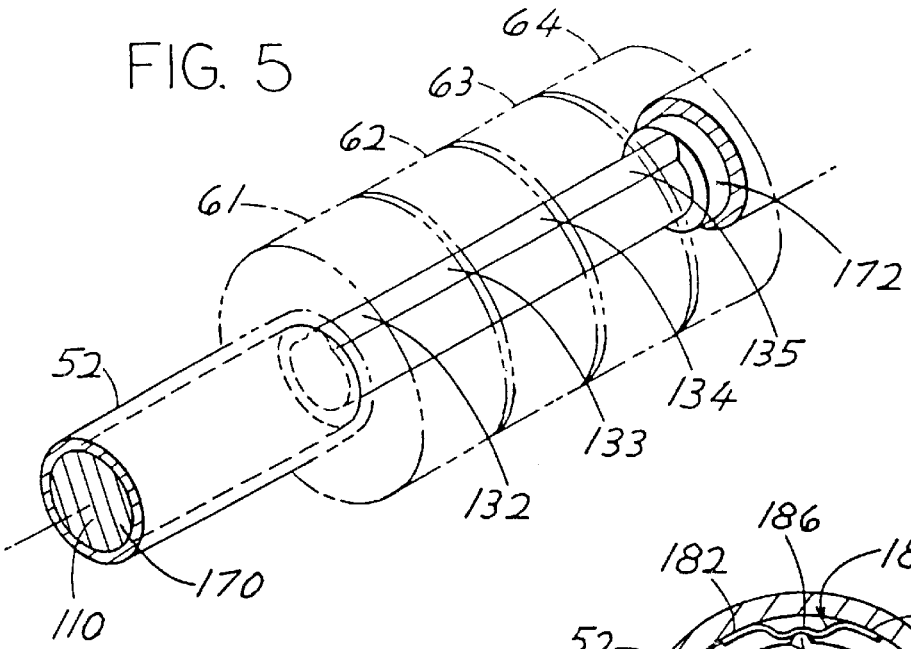
FIG. 6
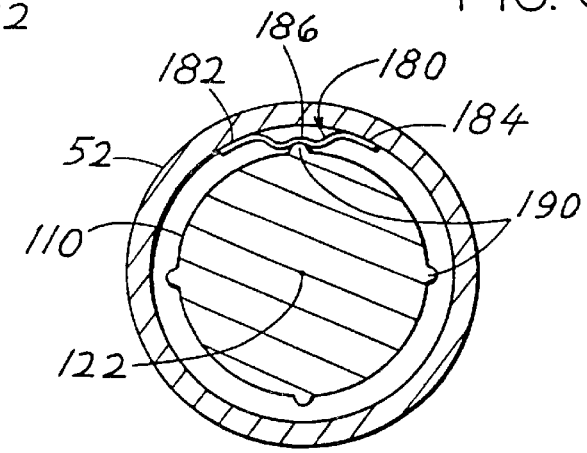
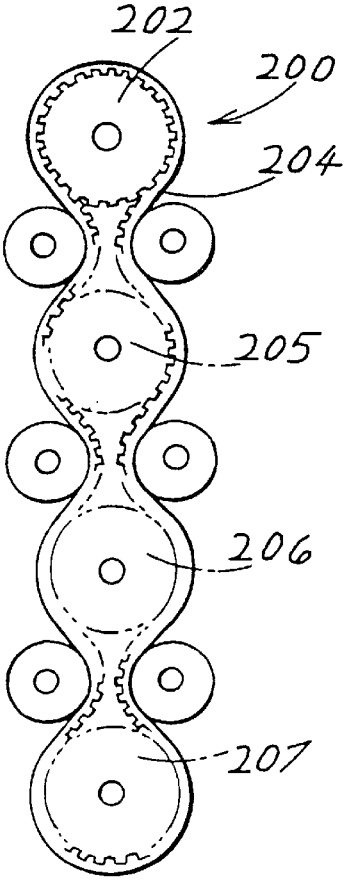
FIG. 10
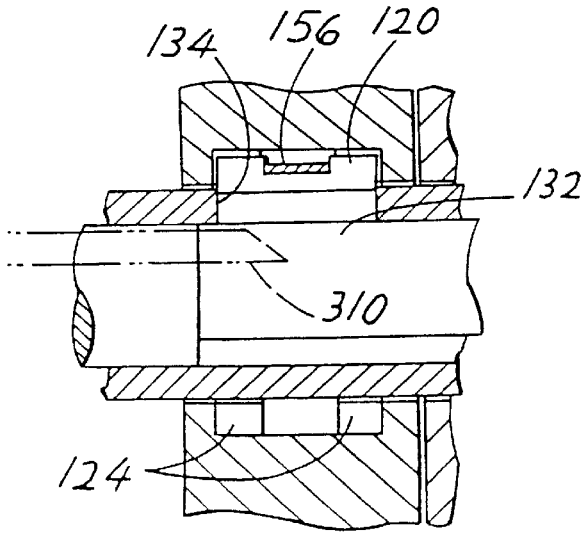
FIG. 7

MECHANISM FOR COUPLING OF CONNECTOR ARRAY

BACKGROUND OF THE INVENTION

There are situations where a plurality of second connectors must be mated to first connectors, where the connectors are located at the rear of a drawer or other container where they are not readily accessible. Mating of the connectors is accomplished by turning a knob or other control at the panel to turn a shaft that extends to the second connectors to move them. In one type of drive mechanism, a turning member rotates a number of jackscrews that each advances a second connector into engagement with a first connector, to simultaneously mate all pairs of connectors. Each connector may include multiple contacts, so a large force is required to mate each pair of connectors. As a result it is difficult to turn the mechanism and it is difficult to transmit sufficient force through the drive mechanism to mate all pairs of connectors simultaneously. It is instead possible to provide a separate drive shaft for each connector, but this results in multiple shafts that take up considerable space within the container.

A drive mechanism that could be operated from the front of a container to move one of a plurality of second connectors at a time into engagement with a corresponding first connector, would reduce the force that had to be applied and had to be carried by a shaft and other mechanisms in order to mate all connectors. Such a drive mechanism would also allow the mating and unmating of a selected one of numerous pairs connectors.

SUMMARY OF THE INVENTION

In accordance with one embodiment of the present invention, apparatus is provided for moving a selected one of a plurality of second connectors into engagement with a corresponding first connector, where the connectors lie rearward of the front of a container, which enables operation from the front of the container. The apparatus includes an elongated turning member that is rotatable about a longitudinal axis, with the turning member having a front end at the front of the container and a rear end. The rear end of the turning member can be coupled to any one of a plurality of gear devices that each turns a jackscrew to move a second connector into engagement with a first connector. A selector that lies within the turning member, has a front end that is moveable between each of a plurality of positions to move a selected coupler at the rear of the turning member to an engaged position. In the engaged position, the coupler engages both the turning member and a selected one of the gear devices. Subsequent turning of the turning member causes the selected coupler to the turn the selected gear device. The selector turns with the turning member.

In one apparatus, the selector member can be turned to any of a plurality of rotational positions within the turning member. The selector member has a rear that forms a plurality of cams. The selected cam is turned to a position wherein it pushes the selected coupler radially outwardly along a slot in the turning member, so the coupler engages a cutout in the hub portion of the selected gear device. Turning of the turning member then turns the coupler and causes the coupler to turn the selected gear device.

In another apparatus, the selector member is slideably axially along the axis of the turning member, as by turning a screw at the front of the selector member. The rear of the selector member has a plurality of couplers that are slid so one of them engages the walls of a cutout in the selected gear device.

The novel features of the invention are set forth with particularity in the appended claims. The invention will be best understood from the following description when read in conjunction with the accompanying drawings.

BRIEF DESCRIPTION OF THE DRAWINGS

FIG. 5 is a partial isometric view of the selector member of the apparatus of FIG. 3, and showing a portion of the turning member, and showing the four gear devices in phantom lines.

FIG. 6 is a sectional view of the front end of the apparatus of FIG. 1, showing a detent mechanism that fixes the rotational position of the selector with respect to the turning member, at any one of a plurality of rotational positions.

FIG. 7 is a sectional view taken on line 7—7 of FIG. 3.

FIG. 10 is a front view of gear devices of another embodiment of the invention.

DESCRIPTION OF THE PREFERRED EMBODIMENTS

Figures 1, 2:
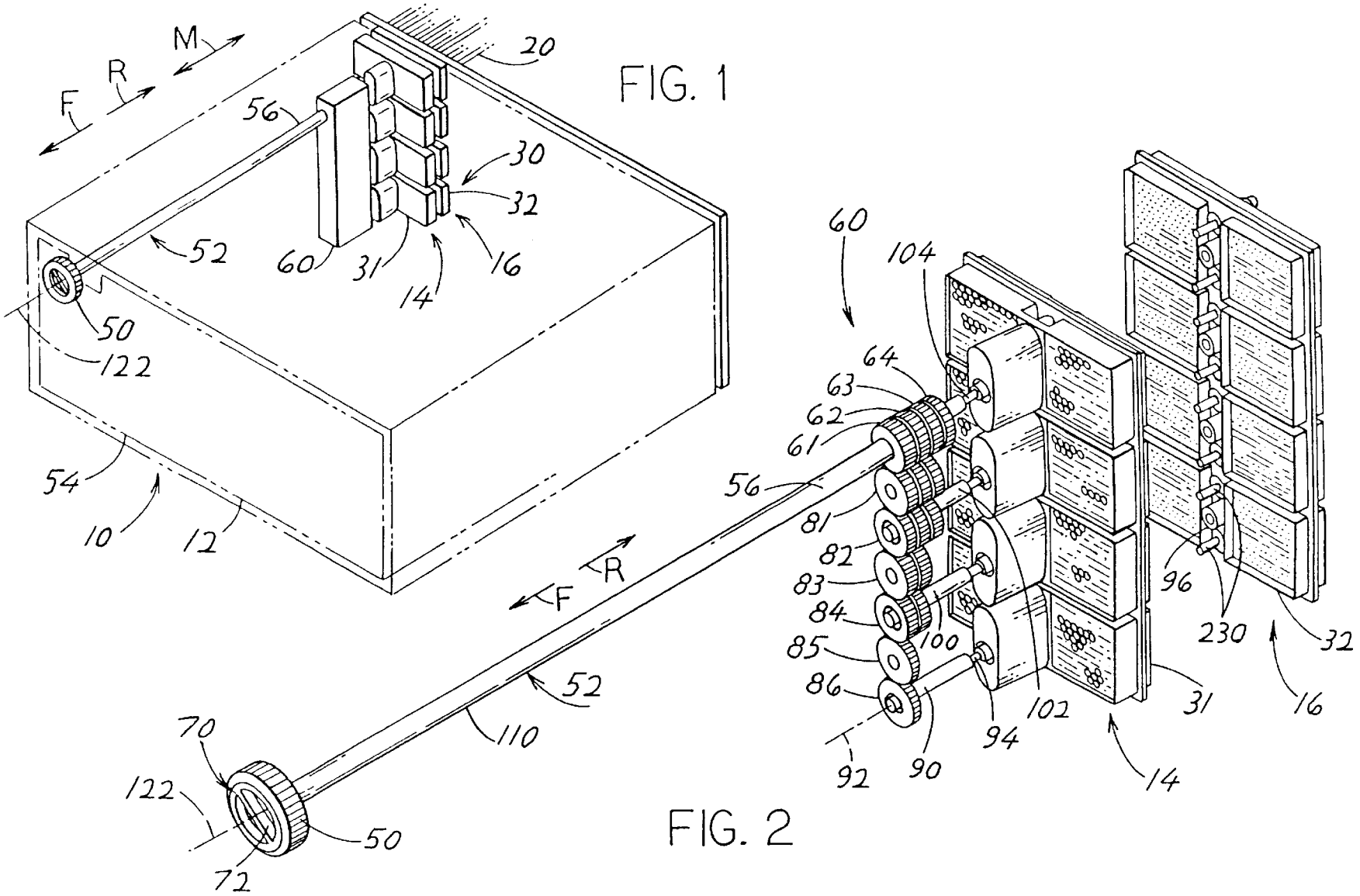
FIG. 1 is an isometric view of an apparatus of a first embodiment of the invention, with a container on which the apparatus is mounted being shown in phantom lines.
FIG. 2 is an isometric view of the apparatus of FIG. 1, with the second connector shown spaced from the first connectors by more than actually occurs in the apparatus.

FIG. 1 illustrates a container 10 that holds a large amount of data control equipment 12 such as multiple switches, and that holds first and second groups of connectors 14, 16. In one example, the second connectors 16 are located slightly beyond a rear wall of the container and multiple cable 20 extend rearwardly from the second connector. Each connector group includes a plurality of connectors, with four connectors being illustrated for each group. The connectors are arranged in pairs, so that a first pair 30 includes a first connector 31 of the pair that is mated to a second connector 32 of the pair by moving the second connector forwardly F against the first connector. Sometimes, all four pairs of connectors must be mated. Also, such mating is accomplished by operating the front end 50 of a turning member 52. The front end of the turning member is readily accessible from the front of the container, as where it lies at or slightly forward of a front panel 54 at the front of the container.

The rear end 56 of the turning member is connected to a transmission 60 that is connected to the connectors 14, 16 to move the second connectors against the first ones. It would be relatively simple to construct the transmission so all four sets of connectors are mated simultaneously. However, each of the connector pairs requires a large force to mate or unmate it from the corresponding other connector of the pair.

Also, there are times when only a selected one of the four pairs of connectors are to be mated or unmated.

It should be noted that the connectors 14, 16 may have electrical contacts with pairs of such contacts engaging one another to pass electrical currents. In another application, the connectors hold optical contacts where the ends of optical fibers are coupled to one another as by moving their ends against one another (as where they have flat tips) or close to one another (as where they have spherical ends).

FIG. 2 shows that the transmission 60 includes multiple gear devices, including four gear devices 61–64 lying around the rear end 56 of the turning member. However, most of the gear devices 61 64 may be rotatably unconnected to the turning member, so most of the gear devices are not turned when the turning member turns. However, a selector 70 is provided which selectively connects one of the gear devices 61–64 to the turning member 52 so that gear device turns when the turning member turns. The selector 70 has a front end 72 that forms a handle that is operable from the front end of the container, adjacent to the front end 50 of the turning member.

The first gear device 61 is connected through a plurality of gears 81–86 to a threaded shaft, or jackscrew 90. The jackscrew, which has a few elongated parts extending along an axis 92, extends through a hole 94 in the first connector. The jackscrew has a threaded end that can engage a threaded nut 96 on the second connector 32. It is noted that FIG. 2 shows the second group 16 of connectors spaced far from the first group 14 to indicate the construction of the second group, but the first and second connectors are spaced much closer together, as is shown in FIG. 1, even when they are unmated.

If the selector 70 is operated to connect the turning member 52 to a different one of the gear devices 62–64, then a different one of the threaded shafts 100, 102, 104 is rotated whenever the turning member 52 is turned, to move a different one of the second connectors against its corresponding first connector. It should be noted that applicant uses the term "gear device" to indicate a member that rotates and that has teeth or sprockets. Such teeth or sprockets can engage a gear, as is shown in FIG. 2, or can engage a belt or endless chain that wraps around another gear device or sprocket wheel to turn it.

Figure 3:
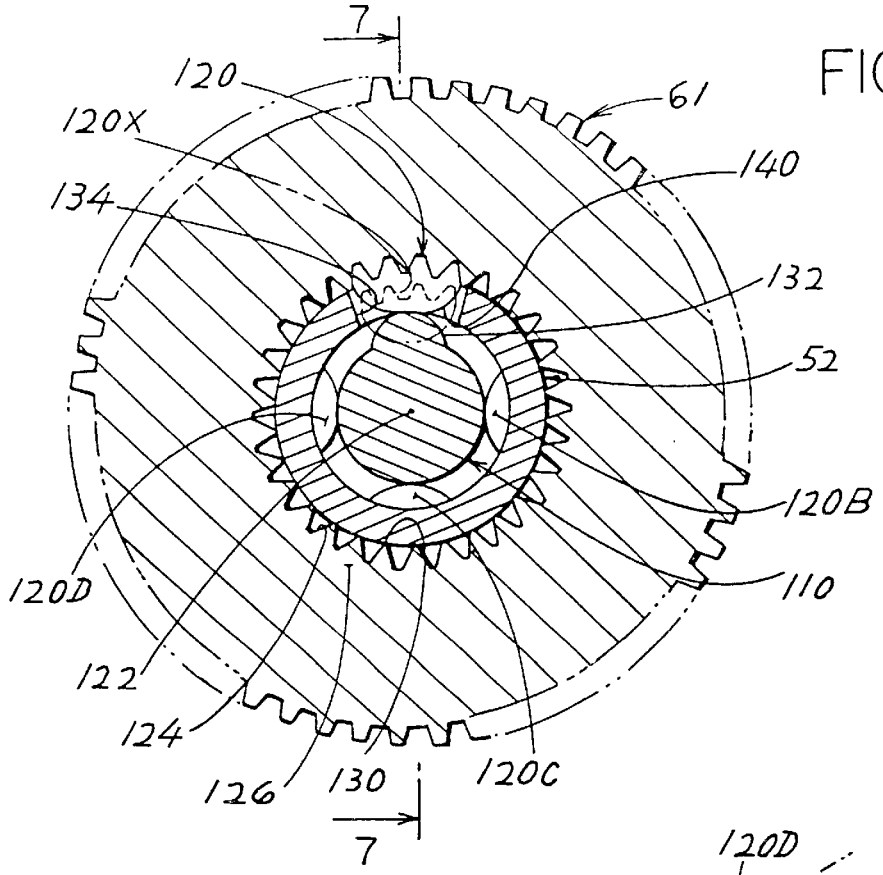
FIG. 3 is a sectional view of one of the gear devices of FIG. 2.

The selector 70 has a selector shaft 110 that extends through the turning member 52. FIG. 3 shows how turning of the selector shaft 110 causes engagement or disengagement of the turning member 52 with the first gear device 61. The mechanism includes a gear connector or coupler 120 that can slide between the position 120X shown in phantom lines and the position 120 that is shown in solid lines in FIG. 3. Initially a spring urges the coupler 120 radially inwardly, towards the axis 122 of the turning member. In that position 120X, the coupler does not engage the walls of driving cutouts 124 that are formed in the hub portion 126 of the gear device. The gear device has a hole 130 that receives the turning member 52, but the turning member can turn without also turning the gear device. However, when the selector shaft 110 is turned so a cam portion 132 on the selector shaft pushes the coupler 120 radially outwardly to the position shown in solid lines, the coupler engages the walls of the cutouts 124 in the gear device, to thereby engage the gear device. At the same time, the coupler continues to lie in a slot 134 in the turning member. As a result, the coupler rotatably connects the gear device 61 to the turning member 52 so they turn together.

In order to connect the turning member 52 to the first gear device 61, as is shown in FIG. 3, a person turns a handle 72 (FIG. 2) at the front end of the selector shaft 110. At the same time, the person holds the turning member handle 50 to prevent it from turning. Such turning of the selector handle 72 relative to the turning member handle 50 causes the cam part 132 (FIG. 3) to turn to a selected position such as shown in FIG. 3 to couple the turning member to the first gear device 61. It is noted that the cam portion presses radially outwardly (with respect to axis 122) against an inner surface 140 of the coupler 120 to push it radially outward. If the selector shaft 110 and its cam is turned clockwise by 90°, then the cam presses outward against a second coupler 120B to push the second coupler 120B into engagement with the second gear 62. At the same time, the first coupler 120 moves radially inwardly under the force of a spring, so it is no longer connected to the first gear device 61. Additional couplers 120C, 120D are provided for coupling the turning member to one of the other gear devices 63, 64. Thus, turning of the selector shaft 110 about the turning member axis 122 enables a person to operate the front end of the selector so as to rotatably connect the turning member 52 to a selected one of the four gear devices.

Figure 4:
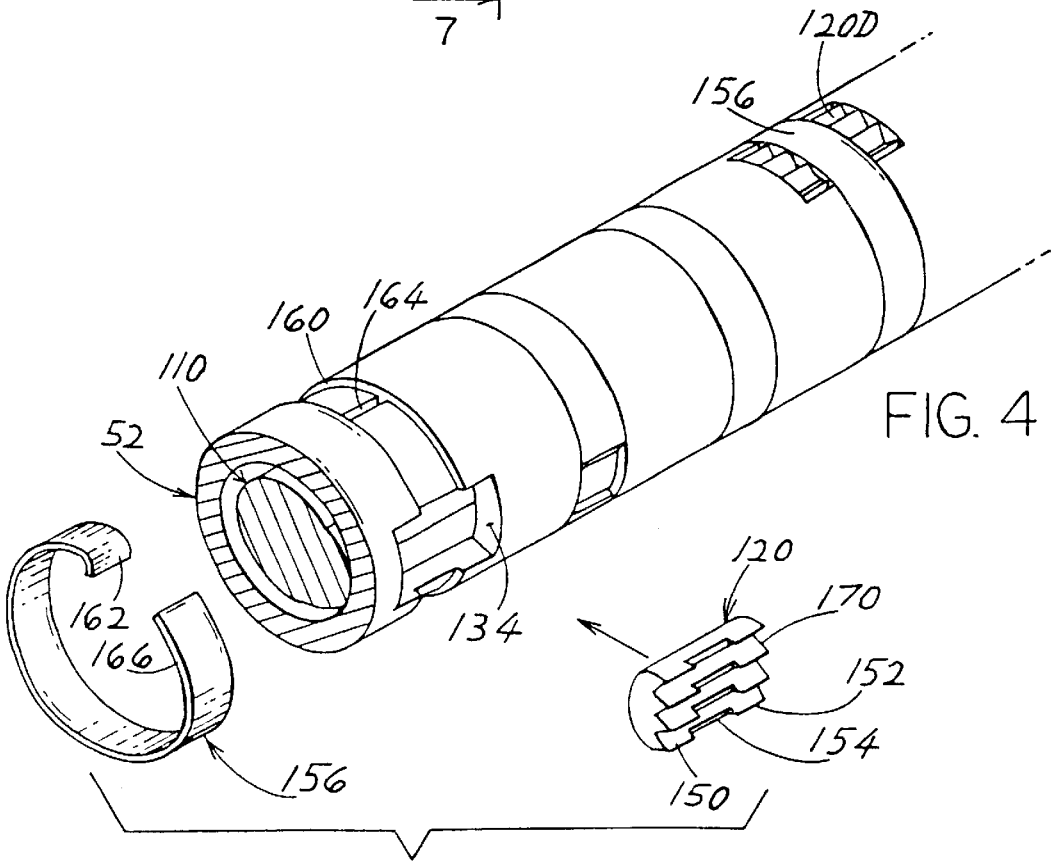
FIG. 4 is an exploded partial isometric view of the apparatus shown in FIG. 3.

FIG. 4 shows some details of the mechanism by which the selector shaft 110 selects one of the plurality of gear devices to be turned by the turning member 52. The coupler 120 has axially-spaced coupler ends 150, 152 and has a recess 154 between them. A leaf spring 156 extends around the turning member 52, in a shallow groove 160 therein. One end 162 of the leaf spring extends into a slot 164, while the other end 166 of the leaf spring is free to slide within the groove 160, but is biased to tend to remain in the groove. The leaf spring lies in the recess 154 of the coupler, to bias the coupler radially inwardly. The opposite ends 150, 152 of the coupler are shown to contain four gear-like teeth 170, and the gear device 61 (FIG. 3) has corresponding teeth-receiving cutouts 124. This enables the teeth 170 of the coupler to slide radially outwardly into corresponding teeth-receiving cutouts in the hub of the gear device, at substantially any rotational position of the turning member with respect to the selected gear device. If the tips of the teeth 170 of the coupler should happen to abut the radially inner ends or teeth of the cutouts, the turning member can be turned a few degrees in either direction to allow the coupler to spring outwardly. Actually, this will happen automatically when the turning member starts to turn. FIG. 4 shows the fourth coupler 120D moved to its radially inward position by its leaf spring 156.

FIG. 5 shows that the selector shaft 110 has portions such as 170, 172 that are closely rotatably mounted within the turning member 52, and has four cam portions 132–135 that each can push out one of the four couplings to connect a gear device 61–64 to the turning member.

FIG. 6 shows one form of detent device 180 lying at the front end of the turning member 52 and the front end of the selector shaft 110, where the detent device retains the selector shaft 110 in any one of four rotational positions. The detent device is in the form of a leaf spring with one end 182 fixed to the turning member 52, with the other end 184 pressing against the inside of the turning member but able to slide, and with a middle 186 pressing against one of four projections 190 on the selector shaft 110. A variety of detent mechanisms can be used.

FIG. 10 shows a transmission 200 where a gear device 202 engages a timing belt 204 that is pressed against three other gear devices 205–207 that each turns a jackscrew to move a second connector against a first one.

Figure 8:
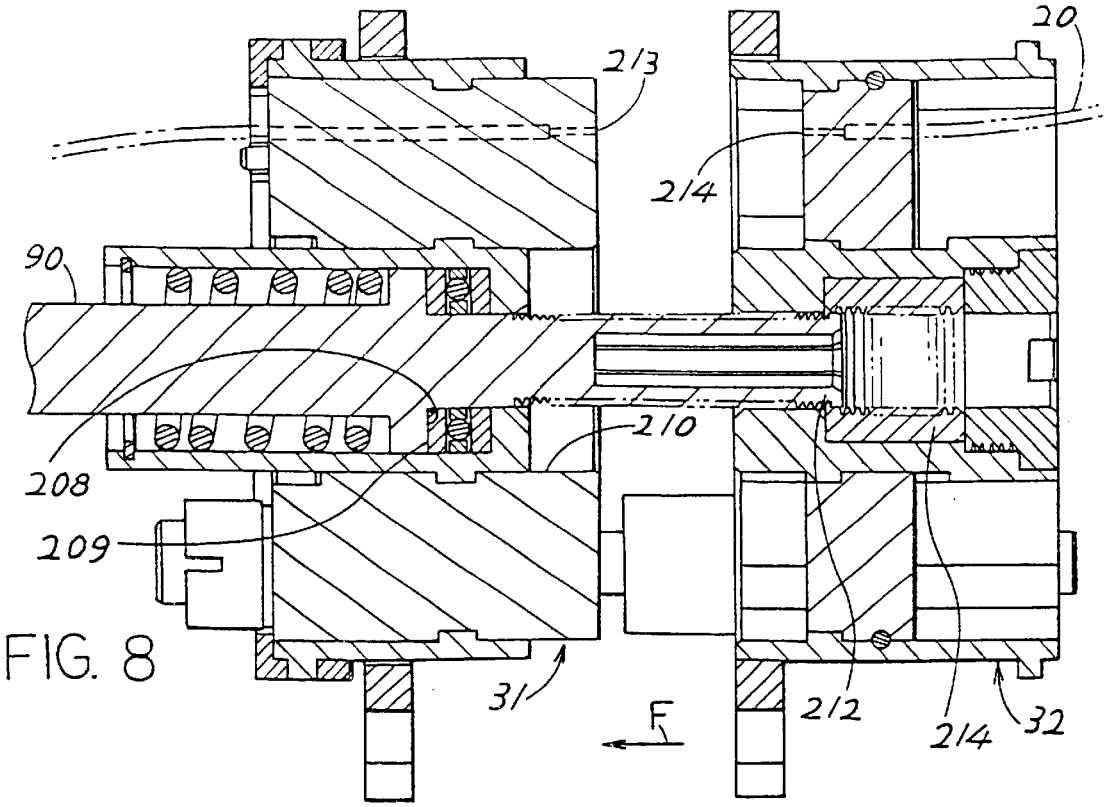
FIG. 8 is a sectional view showing a pair of first and second connectors that are not mated to each other.
Figure 9:
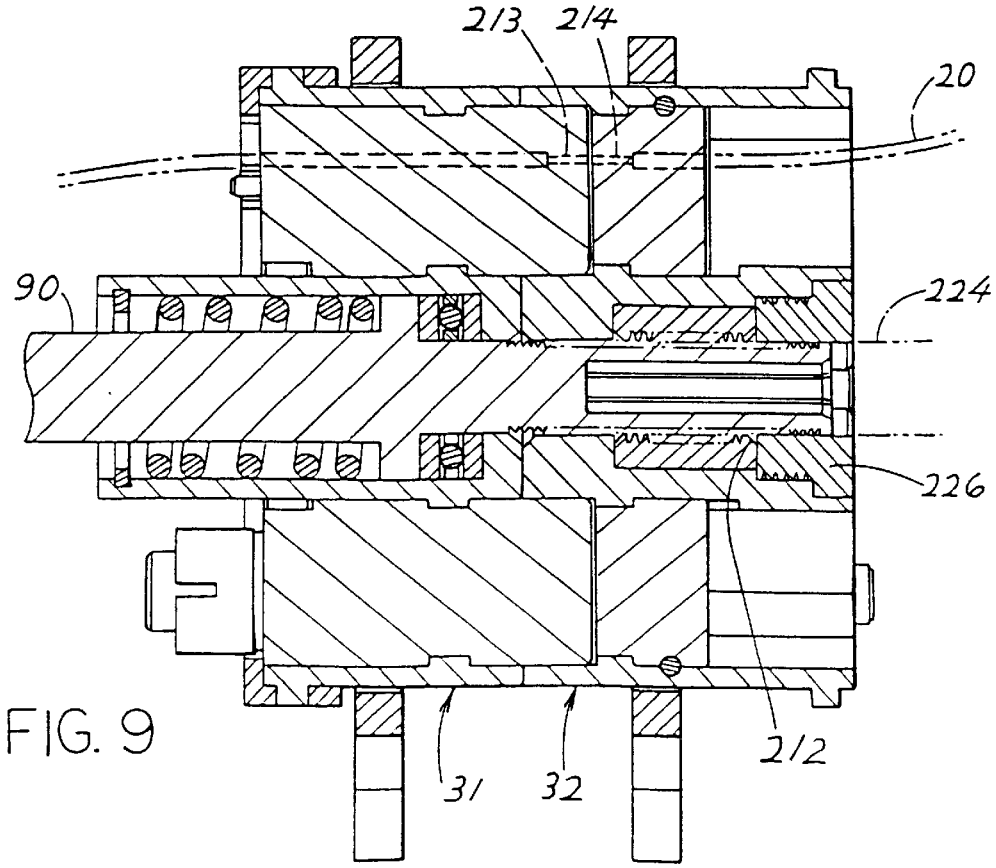
FIG. 9 is a sectional view similar to that of FIG. 8, but with the first and second connectors fully mated.

FIGS. 8 and 9 show how the jackscrew 90 moves first and second connectors 31, 32 of a pair into engagement. The jackscrew extends through a hole 210 in the first connector 31, and the jackscrew has a threaded end 212 that is threadably engaged with a threaded nut 214 mounted on the second connector 32. When the jackscrew is turned in a tightening direction, it pulls the second connector 32 in the forward direction F towards the first connector. The jackscrew has a shaft shoulder 208 that engages a connector shoulder 209 to keep the first connector from moving forward. FIG. 9 shows the jackscrew fully threaded and tightened into the nut 212, and with the connectors fully engaged.

The connectors illustrated in FIGS. 8 and 9 have optical contacts, with the tip of each first optical fiber 213 abutting a tip of a second optical fiber 214. It is noted that the portion rearward of the second connector 32 is a "rat's nest" of optical fiber cables 20, as where each connector has about 120 contacts so 120 cables extend from its rear. If the apparatus for connecting and disconnecting selected connector pairs from the front of the container is not operating, then a long special wrench indicated at 224 can be inserted through the mass of optic cables to engage a part 226 that is fixed to the nut 212 to turn it. As shown in FIG. 2, each of the connectors has a pair of guideposts 230 that accurately guides the connectors together as they mate, with the guideposts 230 always lying at least partially in corresponding precision passages (not shown) formed in the first connectors.

Figures 11, 12:
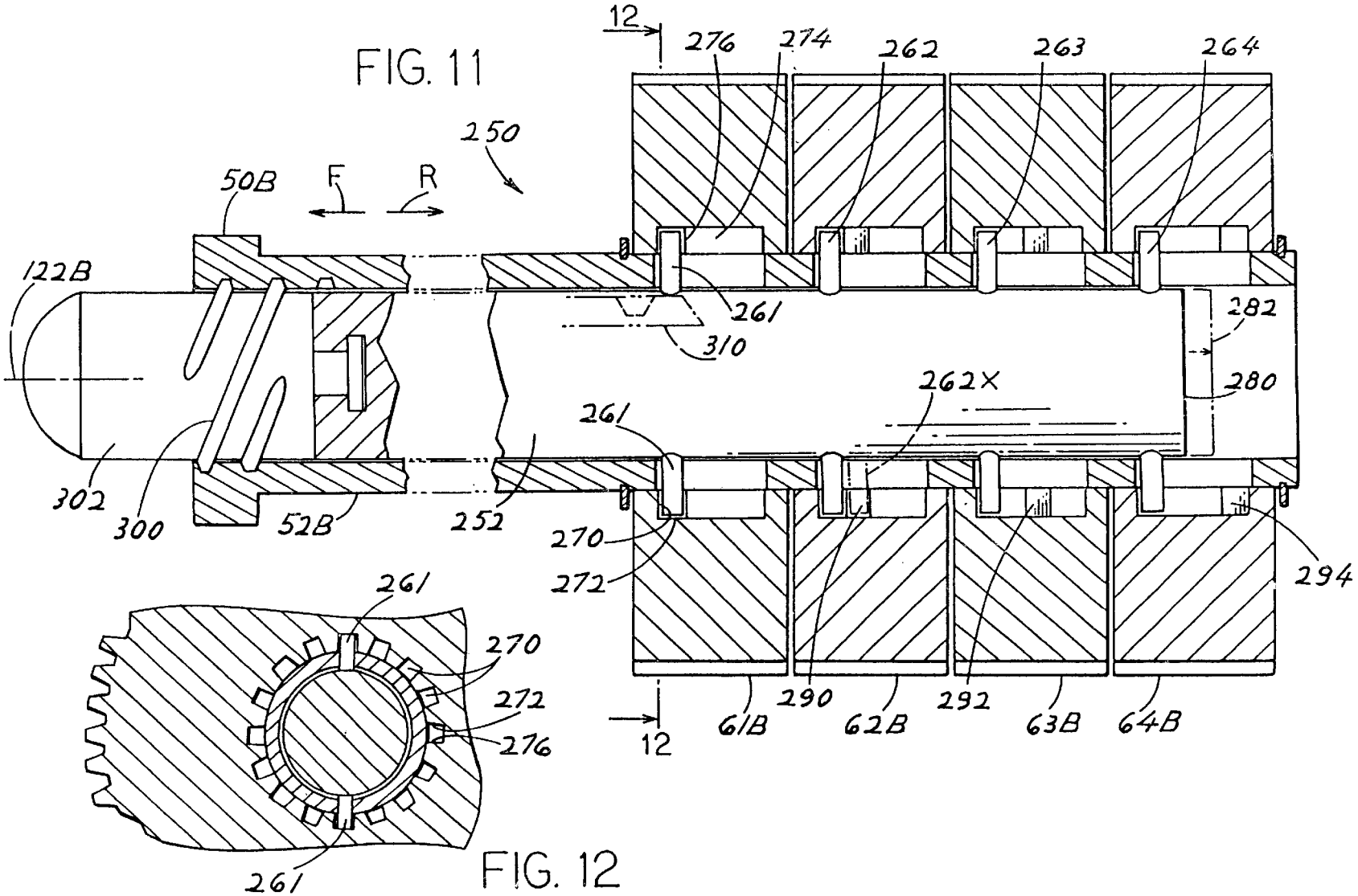
FIG. 11 is a partial sectional view of a drive apparatus constructed in accordance with another embodiment of the invention, wherein the selector member shifts along the axis of the turning member.
FIG. 12 is a partial sectional view taken on line 12—12 of FIG. 11.

FIGS. 11 and 12 show an apparatus 250 of another embodiment of the invention for selectively coupling one of four gear devices 61B–64B to a turning member 52B, where the gear devices lie far rearward of a front end handle 50B of the turning member. In this case, a selector shaft 252 is operated by sliding it forward and rearward along the axis 122B of the turning member. Four pins 261–264 serve as couplings that couple the turning member 52B to a selected one of the gear devices 61B–64B. Each gear device such as 61 B has cutouts at 270, with cutout walls, or projections 272 between adjacent cutouts, at the hub of the gear device. Beside each ring of cutouts, the gear device has an uninterrupted circular groove 274. In the position of the selector shaft 252 shown in FIG. 11, only the first pin 261 lies in a ring of cutouts 276 so as to turn the gear device 61B as the turning member 52B turns. An additional pin 261 is shown in the cutouts.

The selector shaft can be shifted so its rear end moves rearwardly R from the position 280 to the position 282. During such movement, the second pins 262 move to the positions 262X wherein they engage a ring of cutouts 290 in the second gear device 62B. Then, the turning member turns only the second gear device 62B. Further shifting of the selector shaft 252 in the rearward direction moves the third pin 263 into engagement with the third ring of cutouts 292, and still further rearward movement moves the fourth pin 264 into engagement with the fourth ring 294 of cutouts to turn the fourth gear device 264B.

A number of mechanisms can be used to slide the selector shaft 252 along the axis 122B. FIG. 11 shows a large pitch thread 300 on a selector handle 302 which can move the selector handle forward and rearward, to move the selector shaft 252 forward and rearward. The pitch of the thread 300 is large, so each 90° turn of the handle 302 moves a different one of the pins 261–264 into engagement with the ring of cutouts of a different gear device.

Instead of a single selector shaft 252, it is possible to provide four selector shafts such as 310 in FIG. 11, to radially slide out one of the four couplers shown at 120 in FIG. 3. In the above embodiments, the selector shaft generally rotates with the turning member, and the sliding selector shafts are guided in sliding by the turning member.

Thus, the invention provides apparatus for moving a selected one of a plurality of second connectors into engagement with a corresponding first connector, where the selection and movement is made from the front of a container and where the connectors lie far rearward of the front of the container. The apparatus includes a longitudinally-elongated turning member that can be turned about its axis, a plurality of gear devices lying about the turning member, and a selector that can be operated from the front of the container to rotatably connect a selected one of the gear devices to the turning member. In one arrangement, the selector has a selector shaft with cam portions thereon, and the selector shaft can be turned to different angular positions with respect to the turning member to push a selected coupler radially outwardly through a slot in the turning member, so the coupler engages one or more cutouts in the gear device to couple the turning member to the selected gear device. In another arrangement, the selector is slideable parallel to the axis of the turning member shaft and can move pins axially to position them in a cutout or ring of cutouts in the gear device. In another arrangement, one or more selectors slide to push out couplers.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Connector moving apparatus for use with a container having longitudinally spaced front and rear ends, where the apparatus has a front end that is readily accessible and has a rear end that is not readily accessible, where the connector system includes first and second connector assemblies at said container rear end, with said first connector assembly having a plurality of first connectors, and with said second assembly having a plurality of second connectors that are each mateable to a selected one of said first connectors by movement of a second connector of a mateable pair toward the first connector of the pair, where the connector moving apparatus can move a second connector of each pair into and out of a mating position with the first connector of the pair from said front end of said apparatus, comprising:

a longitudinally elongated turning member that has an axis and that can be turned about said axis;

a transmission with a plurality of transmission parts that each couples said turning member to the second connector of a selected one of said pairs of connectors;

a selector having a front end positioned at said front end of said apparatus and extending longitudinally to said transmission and operable to couple said turning member to a selected one of said transmission parts but not to another of said transmission parts.

2. The apparatus described in claim 1 wherein:

each transmission part includes a gear device;

said selector controls rotatable connection of said turning member to the gear device of a selected one of said transmission parts but not to the gear device of another one of said transmission parts.

3. The apparatus described in claim 1 wherein:

said turning member has a passage extending along its length, and said selector includes a selector shaft that lies within said turning member and that is detachably coupled to said turning member to rotate with it, but with said selector shaft being detachable from said turning member so said selector shaft can be pivoted to any one of a plurality of positions with respect to said turning member and then rotatably attached to said turning member at any of said positions;

each of said transmission parts includes a gear device, with the gear devices of said transmission parts each having a hole receiving said turning member and rotatable with respect to said turning member, and a plurality of couplers that are each associated with one of said gear devices and that are each moveable to a position to connect said turning member to the corresponding gear device;

said selector shaft has a rear end with a plurality of cam portions that each can move one of said couplers to rotatably fix the corresponding gear to said turning member only when the cam portion lies at a predetermined rotational position with respect to the turning member.

4. The apparatus described in claim 3 wherein:

each of said gear devices has at least one coupler-receiving cutout for receiving a portion of one of said couplers, and each of said cam portions is positioned to push one of said couplers so a first part of the coupler moves into one of said cutouts while a second part of said coupler lies in engagement with the turning member.

5. The apparatus described in claim 4 including:

a spring that biases each of said couplers out of the cutout in a corresponding gear device;

each cutout is formed in the hole in the gear, said turning member has a slot with one of said couplers lying in the slot, and each coupler has a cam follower portion projecting into the inside of said turning member to be moved radially outward by a cam portion of said selector shaft.

6. The apparatus described in claim 1 wherein:

said transmission parts each includes a gear device, with the gear devices of said transmission parts each having a hole that receives said turning member, with each gear device having at least one cutout with cutout walls, and with each gear device being rotatable with respect to said turning member when not otherwise rotatably connected to the turning member;

said transmission includes a plurality of couplers that each engages said turning member and that are each associated with one of said gear devices, with each coupler being moveable into and out of engagement with the cutout walls of a selected one of said gear devices;

said selector is slideable on said turning member to slide parallel to the axis of said turning member between each of a plurality of axially spaced positions, with said selector being coupled to said couplers to move them into and out of engagement with the cutout walls of said gear devices as the selector slides between said axially spaced positions.

7. Apparatus for use with first and second groups of connectors that are arranged in a plurality of pairs, where each second connector is moveable to mate to the first connector of the pair, and where said groups of connectors each lies longitudinally rearward of the front of a panel, where the apparatus is useful to move a selected one of said second connectors by operation from said front of said panel, comprising:

an elongated turning member that is rotatable about a longitudinal axis, where the turning member has a front end at said panel and has a rear end;

a plurality of jackscrews that each has a threaded part engaged with one of said second connectors to move the second connector when the jackscrew is turned;

a transmission with a plurality of gear devices that are each rotatable and coupled to a selected one of said jackscrews to turn it;

a selector that has front and rear ends positioned respectively at said front and rear ends of said turning member, with said selector being moveable with respect to said turning member;

a plurality of couplers, each associated with one of said gear devices, with each coupler being moveable between a disengage position wherein it disengages said turning member from the corresponding gear device, and an engage position wherein it engages said turning member and the corresponding gear device so when said turning member is turned about said axis it turns the corresponding gear device;

said selector having a front end that is moveable between each of a plurality of select positions and having a rear end that moves a selected one of said couplers to its engage position at each of said select positions.

8. The apparatus described in claim 7 wherein:

said selector is moveable by pivoting it about said longitudinal axis of said turning member;

said gear devices each has a hole that receive said turning member and each gear device has a cutout extending radially into the hole of the gear, said turning member has a plurality of largely radial slots, each coupler is slideable radially outward within one of said slots and into a cutout in a gear device to rotatably connect the turning member to the gear device, and each coupler has a cam follower portion lying in said turning member;

said selector has a plurality of cam portions that are each positioned to push one of said connectors radially outward at a predetermined position of said selector relative to said turning member.

9. The apparatus described in claim 8 wherein:

each of said couplers has axially opposite coupler ends formed to engage said gear device at said cutout, and each of said couplers has a recess between said coupler ends; and including a plurality of leaf springs that each extends around said turning member and through one of said recesses and that resiliently biases one of said couplers away from the corresponding gear device cutout.

10. The apparatus described in claim 7 wherein:

said selector is moveable by sliding it parallel to said axis;

said gear devices each have a hole that receives said turning member and each gear device has a driving cutout, said turning member has a plurality of largely radial slots with one of said couplers lying in each slot and moveable therein, and said selector has a plurality of locations that are each coupled to one of said couplers to move it into engagement with the driving cutout of the corresponding gear device as the selector slides.

11. A method for mating a selected one of a plurality of pairs of connectors by moving the second connector of the pair against the first connector pair, where the connectors lie at the rear of a structure that is readily accessible only at the front of the structure, where the front and rear are longitudinally spaced, comprising:

operating a front end of a selector that is longitudinally elongated to move a rear end of the selector so the rear end of the selector couples a turning member that extends parallel to said selector to a selected one of a plurality of gear devices but not to another one of said plurality of gear devices;

turning a front end of said turning member to turn the selected gear device that is connected to a particular jackscrew, where the jackscrew has a shoulder that bears against the selected first connector of a pair and where the jackscrew has a threaded part that is threadable engaged with the selected second connector of the pair to move the second connector into mating engagement with the first connector.

12. The method described in claim 11 wherein:

said step of operating includes moving a coupler that extends radially from said selector and through a slot in said turning member, from a position where said coupler is out of engagement with a selected gear device to a position where the coupler is in engagement with the gear device so turning of the turning member causes turning of the gear device.

13. The method described in claim 12 wherein:

said step of moving a coupler includes sliding the coupler radially outward with respect to an axis of said turning member, into a cutout in a hub portion of the selected gear device while a portion of the coupler lies in the slot of the turning member.

14. The method described in claim 13 wherein:

said step of operating includes turning the front end of said selector to a predetermined rotational position to turn a cam at the rear of said selector, with the cam pressing the connecting member radially outward at said predetermined rotational position of the cam.

15. Connector moving apparatus for use with a container having longitudinally spaced front and rear ends, where the apparatus has a front end that is readily accessible and has a rear end that is not readily accessible, where the connector system includes first and second connector assemblies at said container rear end, with said first connector assembly having a plurality of first connectors, and with said second assembly having a plurality of second connectors that are each mateable to a selected one of said first connectors by movement of a second connector of a mateable pair toward the first connector of the pair, where the connector moving apparatus can move a second connector of each pair into and out of a mating position with the first connector of the pair from said front end of said apparatus, comprising:

a longitudinally elongated turning member that has an axis and that can be turned about said axis;

a transmission with a plurality of transmission parts that each couples said turning member to the second connector of a selected one of said pairs of connectors;

a selector having a front end positioned at said front end of said apparatus and extending longitudinally to said transmission and operable to couple said turning member to a selected one of said transmission parts;

said turning member has a passage extending along its length, and said selector includes a selector shaft that lies within said turning member and that is detachably coupled to said turning member to rotate with it, but with said selector shaft being detachable from said turning member so said selector shaft can be pivoted to any one of a plurality of positions with respect to said turning member and then rotatably attached to said turning member at any of said positions;

each of said transmission parts includes a gear device, with the gear devices of said transmission parts each having a hole receiving said turning member and rotatable with respect to said turning member, and a plurality of couplers that are each associated with one of said gear devices and that are each moveable to a position to connect said turning member to the corresponding gear device;

said selector shaft has a rear end with a plurality of cam portions that each can move one of said couplers to rotatably fix the corresponding gear to said turning member only when the cam portion lies at a predetermined rotational position with respect to the turning member.

16. Connector moving apparatus for use with a container having longitudinally spaced front and rear ends, where the apparatus has a front end that is readily accessible and has a rear end that is not readily accessible, where the connector system includes first and second connector assemblies at said container rear end, with said first connector assembly having a plurality of first connectors, and with said second assembly having a plurality of second connectors that are each mateable to a selected one of said first connectors by movement of a second connector of a mateable pair toward the first connector of the pair, where the connector moving apparatus can move a second connector of each pair into and out of a mating position with the first connector of the pair from said front end of said apparatus, comprising:

a longitudinally elongated turning member that has an axis and that can be turned about said axis;

a transmission with a plurality of transmission parts that each couples said turning member to the second connector of a selected one of said pairs of connectors;

a selector having a front end positioned at said front end of said apparatus and extending longitudinally to said transmission and operable to couple said turning member to a selected one of said transmission parts;

said transmission parts each includes a gear device, with the gear devices of said transmission parts each having a hole that receives said turning member, with each gear device having at least one cutout with cutout walls, and with each gear device being rotatable with respect to said turning member when not otherwise rotatably connected to the turning member;

said transmission includes a plurality of couplers that each engages said turning member and that are each associated with one of said gear devices, with each coupler being moveable into and out of engagement with the cutout walls of a selected one of said gear devices;

said selector is slideable on said turning member to slide parallel to the axis of said turning member between each of a plurality of axially spaced positions, with said selector being coupled to said couplers to move them into and out of engagement with the cutout walls of said gear devices as the selector slides between said axially spaced positions.

17. A method for mating a selected one of a plurality of pairs of connectors by moving the second connector of the pair against the first connector pair, where the connectors lie at the rear of a structure that is readily accessible only at the front of the structure, where the front and rear are longitudinally spaced, comprising:

operating a front end of a selector that is longitudinally elongated to move a rear end of the selector so the rear end of the selector couples a turning member that extends parallel to said selector to a selected one of a plurality of gear devices;

turning a front end of said turning member to turn the selected gear device that is connected to a particular jackscrew, where the jackscrew has a shoulder that bears against the selected first connector of a pair and where the jackscrew has a threaded part that is threadable engaged with the selected second connector of the pair to move the second connector into mating engagement with the first connector;

said step of operating includes moving a coupler that extends radially from said selector and through a slot in said turning member, from a position where said coupler is out of engagement with a selected gear device to a position where the coupler is in engagement with the gear device so turning of the turning member causes turning of the gear device;

said step of moving a coupler includes sliding the coupler radially outward with respect to an axis of said turning member, into a cutout in a hub portion of the selected gear device while a portion of the coupler lies in the slot of the turning member;

said step of operating includes turning the front end of said selector to a predetermined rotational position to turn a cam at the rear of said selector, with the cam pressing the connecting member radially outward at said predetermined rotational position of the cam.

* * * * *